United States Patent [19]

Lundblade

[11] 4,285,355

[45] Aug. 25, 1981

[54] TENT

[75] Inventor: Gene D. Lundblade, Valley Center, Kans.

[73] Assignee: The Coleman Company, Inc., Wichita, Kans.

[21] Appl. No.: 89,960

[22] Filed: Oct. 31, 1979

[51] Int. Cl.[3] ..... A45F 1/16

[52] U.S. Cl. ..... 135/4 R; 135/3 E

[58] Field of Search ..... 135/1 R, 3 R, 3 E, 4 R

[56] References Cited

U.S. PATENT DOCUMENTS

| | | | |
|---|---|---|---|
| 2,084,524 | 6/1937 | Eide | 135/3 R |
| 2,963,030 | 12/1960 | Blanchard | 135/3 E |
| 3,058,480 | 10/1962 | Blanchard | 135/3 E |
| 3,128,781 | 4/1964 | Kirkham | 135/3 R X |
| 3,181,542 | 5/1965 | Bareis | 135/3 E X |
| 3,223,098 | 12/1965 | Dole | 135/3 E X |
| 3,367,348 | 2/1968 | Kirkham | 135/4 R |
| 3,834,410 | 9/1974 | Leibel | 135/3 E |
| 4,078,572 | 3/1978 | Moss | 135/3 R X |

*Primary Examiner*—J. Karl Bell

[57] ABSTRACT

A tent utilizes a unique frame assembly which permits the tent to be pitched quickly and without fastening it to the ground. The interrelationship between the frame members and between the frame members and the tent fabric provides a stable, rigid, and free-standing assembly.

15 Claims, 21 Drawing Figures

FIG. 12
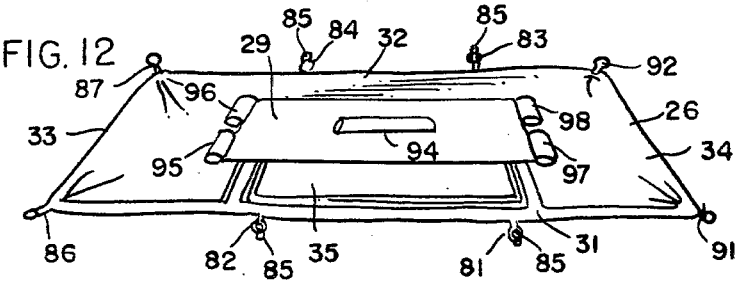
FIG. 13
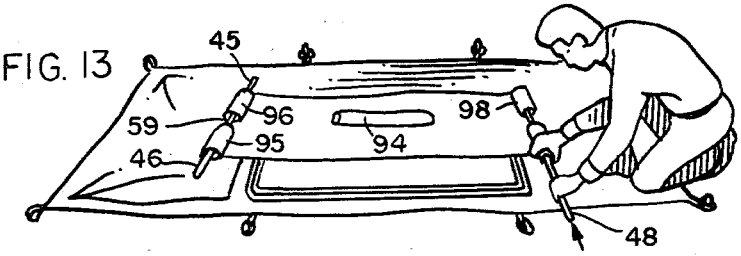
FIG. 14
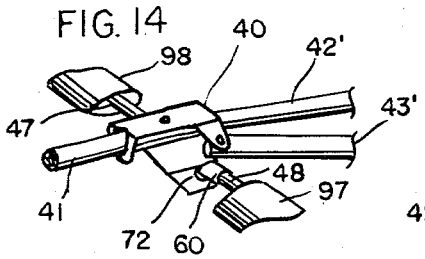
FIG. 15
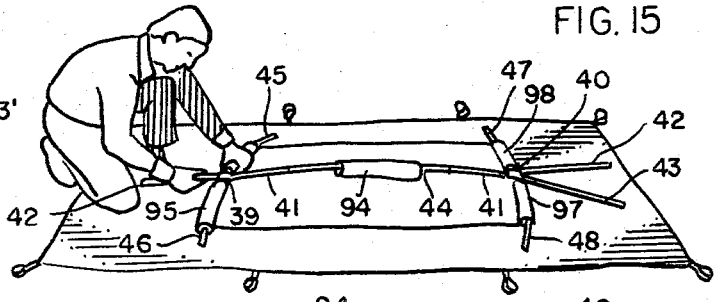
FIG. 16
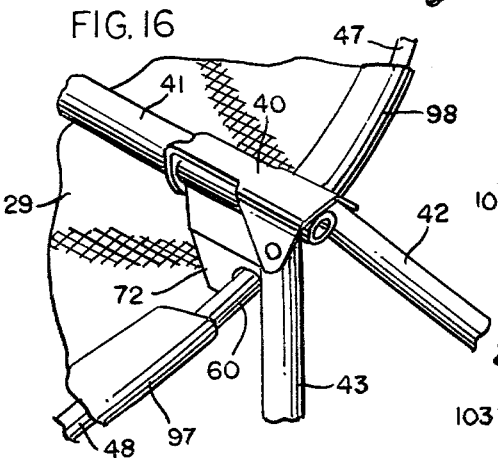
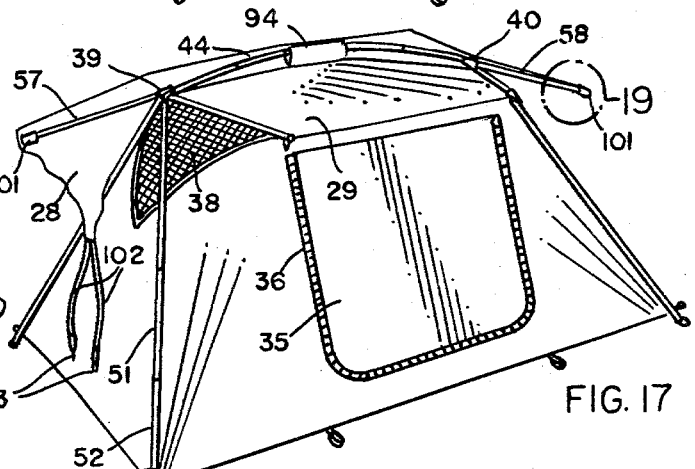
FIG. 17
FIG. 18
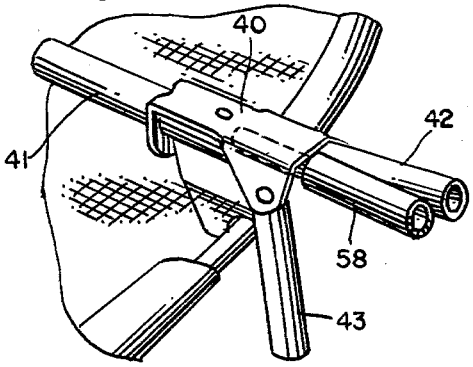
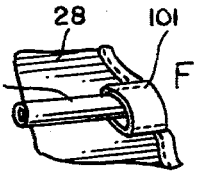
FIG. 19
FIG. 20
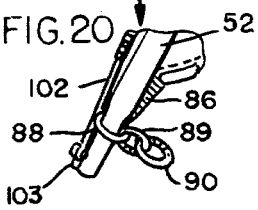
FIG. 21
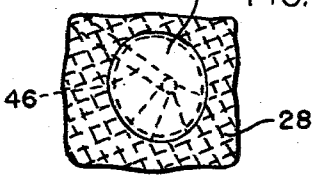

TENT

BACKGROUND AND SUMMARY

This invention relates to tents, and, more particularly, to a tent which is easy to erect and which is stable without being attached to the ground.

Tent design is subject to a number of competing considerations. For example, it is usually desirable that a tent be easy to erect, roomy, and stable. Tents which are intended for use by backpackers should also be lightweight. However, the tents which are the easiest to erect are often relatively small. Tents which are relatively roomy are more difficult to erect and may be relatively heavy.

The invention provides a tent which is easy to erect, roomy, and lightweight. The tent can be erected without being attached to the ground so that the tent can be pitched on rocky ground or other hard surfaces and can be moved to a new location without disassembly. A pair of unique brackets interconnect a ridge pole, a pair of spreader rods, and two pairs of upright poles. The upright poles are pivotally connected to the bracket, and when the tent is erected and the upright poles are connected to the tent fabric, the upright poles are restrained from pivoting in either direction so that the tent is maintained in a stable condition. A fly can be used to cover the tent without attaching the fly to the ground. A fly support rod is connected to each of the brackets, and the fly is supported by the ridge pole, the spreader rods, and the fly support rods. Elastic straps are used to connect the corners of the fly to the lower ends of the upright poles.

DESCRIPTION OF THE DRAWING

The invention will be explained in conjunction with an illustrative embodiment shown in the accompanying drawing, in which

FIG. 12 is a perspective view of the tent fabric laid on the ground before erecting the tent;

FIG. 13 illustrates the spreader rods being connected to the tent fabric;

FIG. 14 is a fragmentary perspective view showing one of the brackets connected to one of the spreader rods;

FIG. 15 illustrates the second bracket being connected to the other spreader rod;

FIG. 16 is a fragmentary perspective view of one of the brackets after both brackets are connected to the spreader rods;

FIG. 17 is a perspective view of the tent showing the fly being attached;

FIG. 18 is a perspective view similar to FIG. 16 showing the attachment of one of the fly support rods to one of the brackets;

FIG. 19 is an enlarged fragmentary perspective view showing the connection between the fly and one of the fly support rods;

FIG. 20 is an enlarged fragmentary perspective view showing the connection between the bottom of one of the upright poles and the tent fabric and the fly; and FIG. 21 is a fragmentary perspective view of one of the enforcing patches on the fly.

DESCRIPTION OF SPECIFIC EMBODIMENT

Figure 1:
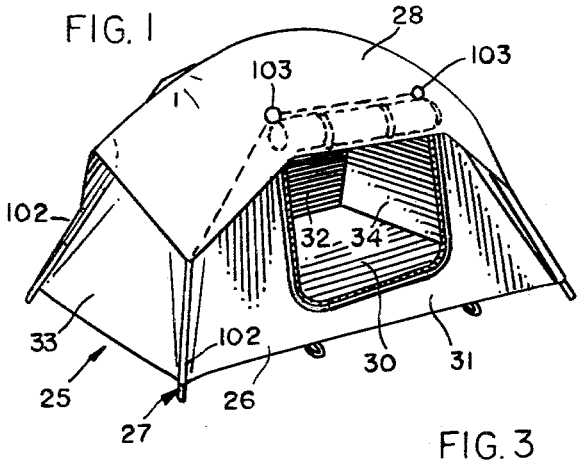
FIG. 1 is a perspective view of a tent formed in accordance with the invention.
Figure 2:
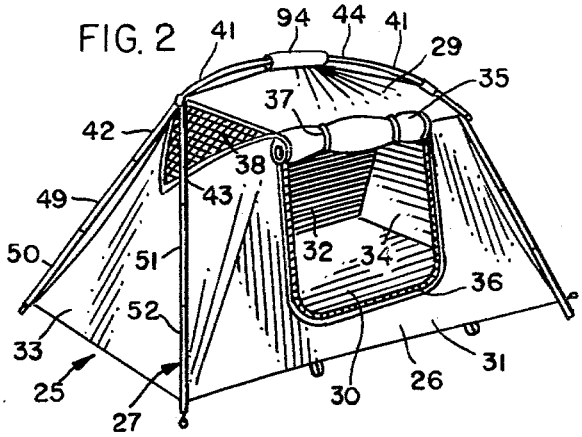
FIG. 2 is a perspective view of the tent of FIG. 1 without the fly.

Referring first to FIGS. 1 and 2, a tent 25 comprises a cover or tent fabric 26, a frame assembly 27, and a fly 28. The tent fabric includes a top portion 29, a bottom portion 30, a pair of side portions 31 and 32, and a pair of end portions 33 and 34 which form a tent enclosure. The various portions of the tent fabric can be provided by panels which are stitched together. The side portion 31 includes a generally rectangular door panel 35 which can be detached from the remainder of the side portion around three sides by a slide fastener 36. In FIGS. 1 and 2 the door panel is rolled up and secured by ties 37. Each of the end portions of the tent fabric is provided with a window 38 which is covered with mesh fabric.

Figure 3:
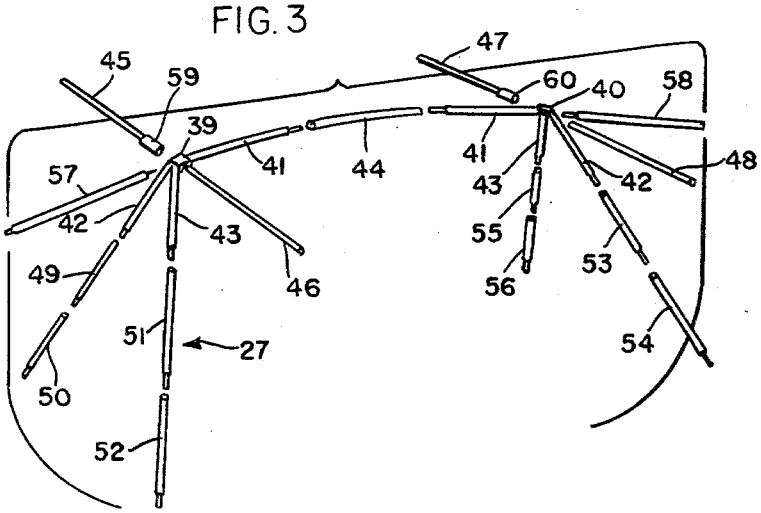
FIG. 3 is an exploded perspective view of the frame assembly of the tent.
Figure 4:
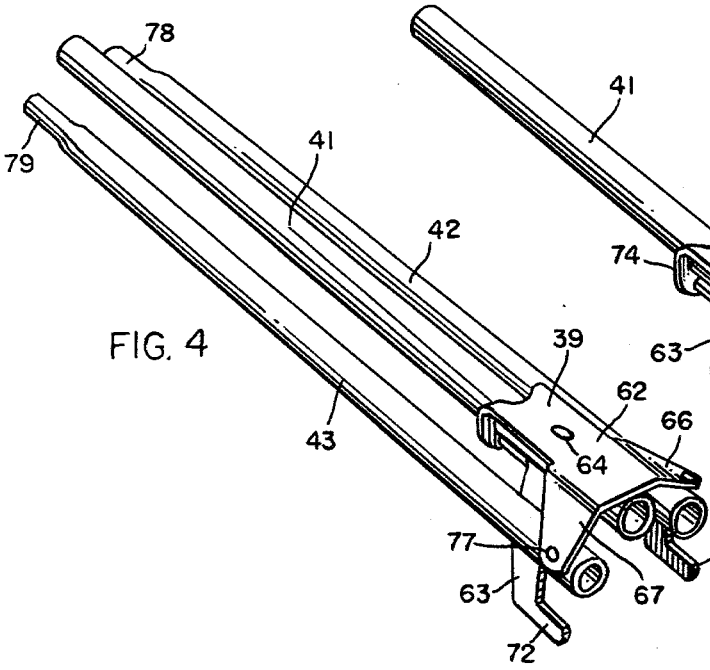
FIG. 4 is a perspective view of one of the brackets in a folded condition.
Figure 5:
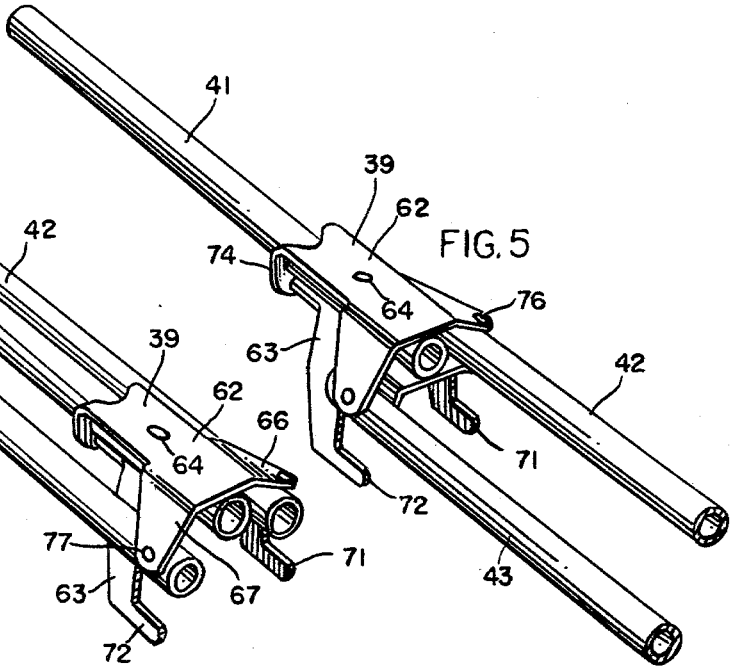
FIG. 5 is a fragmentary perspective view of one of the brackets in an unfolded condition.
Figure 6:
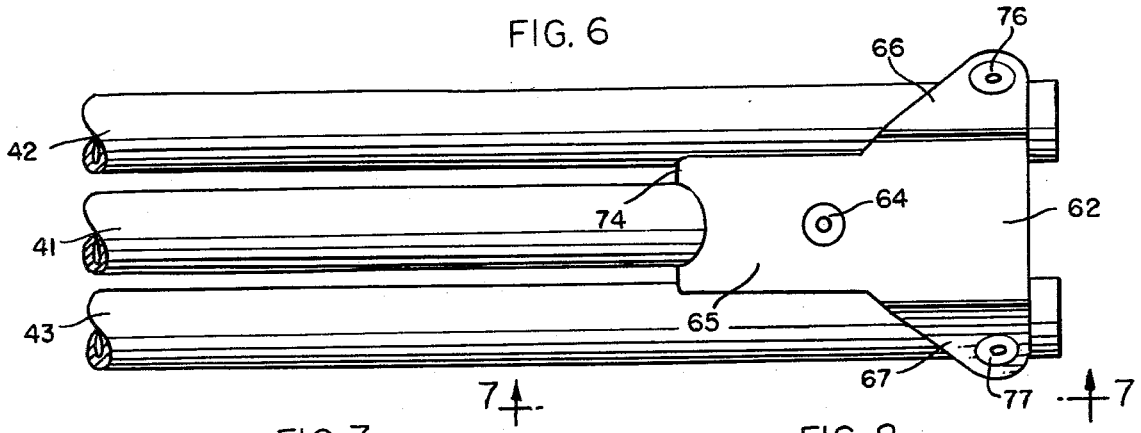
FIG. 6 is a fragmentary top plan view of the bracket of FIG. 4.
Figure 7:
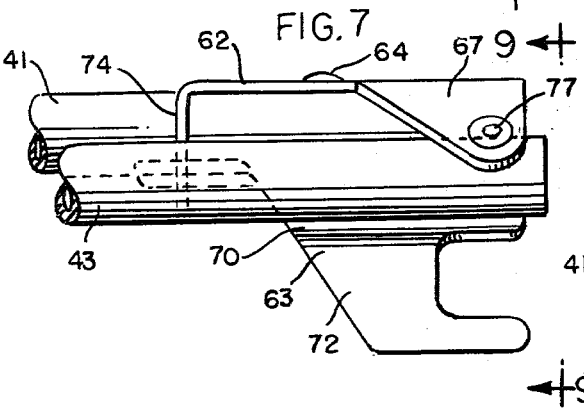
FIG. 7 is a fragmentary side elevational view of the bracket taken along the line 7—7 of FIG. 6.
Figure 8:
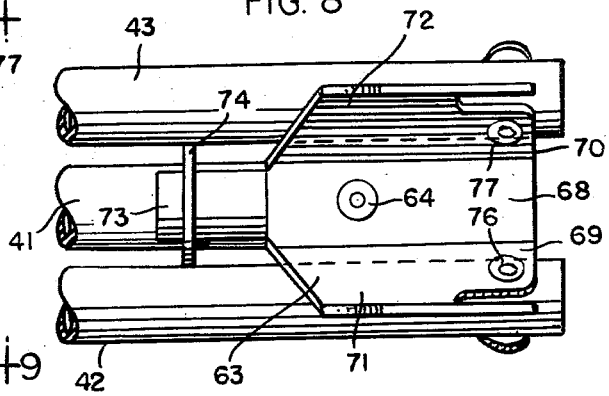
FIG. 8 is a fragmentary bottom plan view of the bracket.
Figure 9:
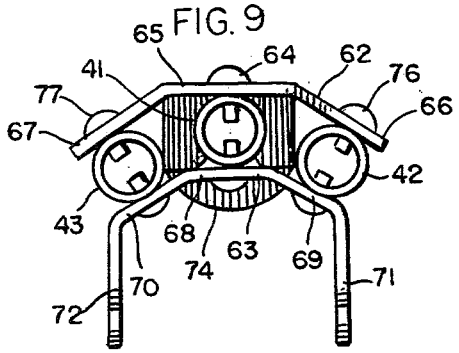
FIG. 9 is an end elevational view of the bracket taken along the line 9—9 of FIG. 7.
Figure 10:
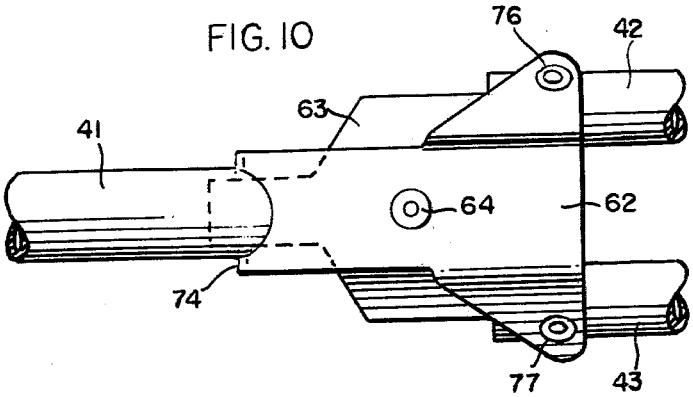
FIG. 10 is a fragmentary top plan view of the unfolded bracket of FIG. 5.
Figure 11:
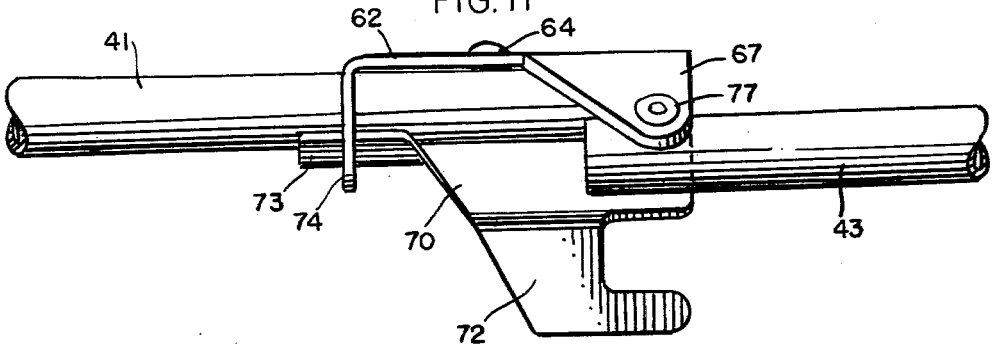
FIG. 11 is a fragmentary side elevational view of the unfolded bracket.

The frame assembly is illustrated in FIG. 3 and includes a pair of brackets 39 and 40, each of which includes three tubes 41, 42 and 43; a ridge pole 44, which is connected to each of the tubes 41 of the brackets; four spreader rods 45–48, which are connected to the brackets; eight upright pole sections 49–56 which are connected to the tubes 42 and 43 of the brackets; and two fly support rods 57 and 58, which are telescopingly connected to the tubes 41 of the brackets. The spreader rod 45 has a sleeve 59 attached thereto so that the spreader rod 46 can be connected to the spreader rod 45 by inserting the spreader rod 46 into the sleeve. Similarly, the spreader rod 47 includes a sleeve 60 for connecting the spreader rods 47 and 48.

The brackets 39 and 40 are identical, and the details of bracket 39 are illustrated in FIGS. 4–11. The bracket includes upper and lower mounting plates 62 and 63 which are connected to the tube 41 by a rivet 64. The upper mounting plate includes a flat central portion 65 and a pair of angled side portions 66 and 67 which diverge outwardly from the central portion to form an included angle of about 110° (see particularly FIG. 9). The bottom mounting plate similarly includes a flat central portion 68 and a pair of angled side portions 69 and 70 which extend parallel to the corresponding portions of the upper mounting plate. A pair of hook portions 71 and 72 extend from the side portions generally perpendicularly to the central portion 68. The end of the lower mounting plate opposite the hook portions terminates in a curved trough 73 (FIGS. 8 and 11) which extends through a transversely extending tab portion 74 on the upper mounting plate. The tube 41 also extends through the tab portion and is thereby prevented from pivoting with respect to the rivet 64.

The tube 42 is pivotally connected to the side portions 66 and 69 of the upper and lower mounting plates by a rivet 76, and the tube 43 is pivotally connected to the side portions 67 and 70 of the upper and lower mounting plates by a rivet 77. The tubes 42 and 43 are pivotable between a storage position illustrated in FIGS. 4 and 6–8 in which the tubes extends alongside and parallel to the stationary tube 41 and an unfolded position illustrated in FIGS. 5, 10, and 11 in which the tubes 42 and 43 extend parallel to but away from the middle tube 41. The free ends 78 and 79 (FIG. 4) of the tubes 42 and 43 have a reduced cross section to facilitate inserting the tubes into the upright pole sections 49 and 51 (FIG. 3).

The tent fabric 26 is illustrated in FIG. 12 laid out on the ground in preparation for erecting the tent. A pair of stake loops 81 and 82 are attached to the lower edge of the front side portion 31 of the tent fabric, and a pair of stake loops 83 and 84 are attached to the lower edge of the back side portion 32 of the tent fabric. Stakes 85 are driven through these loops to hold the side portion taut, but the tent can be erected without using these stakes.

A pair of elastic straps 86 and 87 are attached to the lower corners of the end portion 33 (see also FIG. 20) for securing the upright poles to the tent fabric. Referring to FIG. 20, each elastic strap passes through a ring 88, and a second strap 89 passes through the ring 88 and a second ring 90. Identical strap-and-ring assemblies 91 and 92 are attached to the corners of the other end panel 34.

A ridge sleeve 94 is attached to the middle of the top panel 35 of the tent fabric and extends parallel to the upper and lower edges of the side portions. A pair of spaced-apart sleeves 95 and 96 are attached to the top portion at the juncture or seam between the top panel and the end portion 33, and a pair of sleeves 97 and 98 are attached to the seam between the top panel and the other end portion 34. The sleeves 95–98 extend generally perpendicularly to the ridge sleeve 94, although in the preferred embodiment each pair of sleeves bows outwardly somewhat away from the ridge sleeve.

FIG. 13 illustrates the tent after the spreader rods 45 and 46 (see FIG. 3) are joined together by the connecting sleeve 59 and inserted through the tent sleeves 95 and 96. The user is in the process of inserting the connected spreader rods 47 and 48 through the sleeves 97 and 98 on the tent fabric. The spreader rods are centered within the fabric sleeves so that the metal connecting sleeves 59 and 60 are positioned in the space between the fabric sleeves.

Referring next to FIG. 15, the ridge pole 44 is inserted through the ridge sleeve 94 on the tent, and one end of the ridge pole is inserted into the middle or stationary tube 41 of the bracket 40. The tube 41 is provided with a stop which limits the distance which the ridge pole can be inserted into the tube to, for example, about two inches. The pivotable tubes 42 and 43 of the bracket 40 are unfolded before the ridge pole is inserted into the tube 41, and the hook portions 71 and 72 of the lower mounting plate are hooked over the metal connecting sleeve 60 (FIG. 14).

The other end of the ridge pole is then inserted into the stationary tube 41 of the bracket 39 as shown in FIG. 15. The distance between the hook portions 71 and 72 of the two brackets 39 and 40 when the ridge pole is inserted into the two tubes 41 is greater than the distance between the two assembled pairs of spreader rods 45–46 and 47–48. Accordingly, in order for the hook portions 71 and 72 of the bracket 39 to be hooked over the connecting sleeve 59 which connects the spreader rods 45 and 46, the spreader rod pairs 45–46 and 47–48 must be forced apart. FIG. 15 illustrates the user pulling the spreader rod 45 with one hand while pushing on the unfolded tubes 42 and 43 of the bracket with the other hand. The spreader rods and the ridge pole are formed of flexible and resilient material such as fiberglass to facilitate the flexing of the spreader rods, and the ridge pole will bow upwardly as shown in FIGS. 15 and 17 to permit the hook portions of the bracket 39 to be passed over the connecting sleeve 59. Once the hook portions are in place, the tensioned ridge pole and brackets will maintain a separating force on the spreader rods and will maintain the top of the tent stretched and taut.

The four pairs of upright pole sections 49–50, 51–52, 53–54, and 55–56 (FIG. 3) are joined together and inserted over the tapered ends of the tubes 42 and 43 of the two brackets 39 and 40. Each of the upright pole sections has a tapered end to facilitate its insertion into the untapered end of another pole section. The upright pole sections and the tubes 42 and 43 can then be pivoted away from each other. Since the tubes 42 and 43 are secured to the angled portions of the upper and lower mounting plates (see, e.g., FIG. 9) pivoting the tubes 42 and 43 away from parallelism with the middle tube 41 will cause the ends of the upright poles to move downwardly relative to the tube 41. The upright poles will therefore support the ridge pole above the ground as illustrated in FIG. 2.

As the tubes 41 and 42 and the attached upright poles are pivoted toward an angle of 90° relative to the tube 41, the ends of the upright poles will move apart. When the poles reach the position illustrated in FIG. 2, in which the poles have not yet reached an angle of 90° to the tube 41, the tapered lower ends of the upright poles are inserted through the rings 88 (FIG. 20) which are attached to the four corners of the tent by the elastic straps 86. The second ring 90 can be used to pull the ring 88 into position below the end of the upright pole. When all of the upright poles are inserted into the appropriate attaching rings, the upright poles will hold the end portions and side portions of the tent fabric taut and will support the ridge pole and tent top as shown in FIG. 2.

The ends of the upright poles are prevented from being spread apart any farther then they are in FIG. 2 by the taut end portions 33 and 34. The ends of the upright poles are prevented from being moved toward each other by the taut side portions 31 and 32. In order for the ends of the upright poles at one end of the tent to be moved toward each other, the tubes 41 and 42 must pivot upwardly toward parallelism with the tube 41 and the distance between the ends of the upright poles at one end of the tent and the upright poles at the other end of the tent must be increased. This is prevented by the side panels of the tent fabric. It will therefore be appreciated that the combination of the various frame members and the tent fabric act together to resist any force, e.g., the weight of the tent, which tends to change the angle between the upright poles. The tent is therefore supported in a stable manner without being attached to the ground. The stakes 85 at the front and back of the tent are not necessary to support the tent, and the erected tent can be moved by removing the stakes and picking the tent up by the ridge pole or the upright poles.

When the upright poles are attached to the corners of the tent, the tubes 42 and 43 are in position to maintain the connecting sleeves 59 and 60 of the spreader rods in the hook portions of the brackets 39 and 40. This is illustrated in FIG. 16. The engagement between the connecting sleeves and the tubes 42 and 43 not only prevents the spreader rods from being disconnected from the brackets but also provides a stop which prevents the tubes 42 and 43 from pivoting too far toward perpendicularity with the tube 41. Accordingly, the force required to prevent further separation of the ends of the upright poles need not be provided entirely by the tent fabric but can also be provided by the engagement of the tubes 42 and 43 with the connecting sleeves. The upright poles can be further secured if desired by driving stakes through the four corner rings 90 into the ground.

FIG. 17 illustrates the fly or cover 28 being attached to the tent. First, fly support rods 57 and 58 are inserted into the ends of the tubes 41 and 42 of the brackets 39 and 40 (compare FIGS. 16 and 18). The fly is a generally rectangular sheet, and sleeves 101 (FIGS. 17 and 19) are attached to opposite edges of the fly along the midline. The ends of the fly support poles 57 and 58 are inserted into the sleeves, and the fly is spread over the top of the tent. An elastic strap 102 is attached to each corner of the fly, and an S-shaped hook 103 (FIG. 20) is attached to the end of each elastic strap. Each of the S hooks is hooked to the lower end of one of the upright poles to draw the fly taut over the top of the tent. The fly covers the windows 38 in the end portions and the upper portion of the door opening so that the windows can be opened to prevent condensation inside the tent under humid conditions. The fly is drawn outwardly over the ends of the spreader rods 45–48, and four reinforcing pads 104 (FIGS. 1 and 21) are sewn to the bottom surface of the fly to prevent the rods from poking through the fly.

The tent is disassembled by following the reverse procedure, and the tent can be erected and disassembled in a matter of minutes. The brackets 39 and 40 can be folded into a compact storage configuration shown in FIG. 4, and the folded brackets and the individual pole sections can be very short, for example, less than two feet long. The tent fabric can be a lightweight material such as nylon, and the brackets and upright pole sections can be aluminum. Accordingly, the tent is lightweight and can be carried compactly by a backpacker.

The unique support system of the invention provides a number of advantages, including:

1. the ability to pitch the tent without fastening it to the ground;
2. relatively vertical walls and horizontal roof for maximizing the usable space inside the tent;
3. combining the ridge, connecting, and upright members into one permanent assembly, i.e., the brackets 39 and 40, thereby reducing the assembly time for pitching the tent;
4. the internal fly support system does not require attachment to the ground;
5. the tent support system allows the fly to protect the windows from all forms of precipitation so that the windows may be opened to prevent condensation inside the tent; and
6. the tent is stable against high winds and snow loads.

Although I have described only a single ridge pole, a plurality of interconnected ridge poles can be used with a tent that has a longer top portion in order to provide additional head room inside the tent and more vertical end walls.

While in the foregoing specification a detailed description of a specific embodiment of the invention was set forth for the purpose of illustration, it will be understood that many of the details herein given may be varied considerably by those skilled in the art without departing from the spirit and scope of the invention.

I claim:

1. A tent assembly comprising a frame assembly and a cover, the cover forming a tent enclosure and having a top and a bottom, the frame assembly comprising:

(a) a pair of brackets, each of the brackets adapted to be removably connected to the top of the cover, (b) an elongated flexible ridge pole adapted to be connected to each of the brackets to maintain the brackets in a spaced-apart condition and to maintain the ridge pole bowed upwardly, (c) means for attaching the ridge pole to the top of the cover whereby the bowed ridge pole will support the top of the cover, and (d) a pair of upright poles adapted to be connected to each of the brackets, each of brackets including means for pivotally connecting the upright poles to the bracket.

2. The tent assembly of claim 1 including a pair of elongated spreader rods adapted to be connected to the top of the cover and means on each of the brackets for removably connecting each bracket to one of the spreader rods.

3. The tent assembly of claim 2 in which each of the spreader rods is flexible.

4. The tent assembly of claim 1 in which each of the brackets includes a mounting plate, a first tube connected to the mounting plate, and second and third tubes pivotally connected to the mounting plate, said first tube adapted to be connected to the ridge pole and each of said second and third tubes adapted to be connected to one of the upright poles.

5. The tent assembly of claim 4 in which the mounting plate for each of the brackets includes a central portion and a pair of side portions which extend from the central portion to form an included angle of less than 180°, said first tube being connected to said central portion and each of said second and third tubes being pivotally connected to one of said side portions whereby said second and third tubes can be pivoted between a first position in which the second and third tubes extend parallel to said first tube and a second position in which each of the second and third tubes extend perpendicular to the first tube.

6. The tent assembly of claim 1 in which the means for attaching the ridge pole to the top of the cover comprises a sleeve attached to the top of the cover.

7. A tent assembly comprising a frame assembly and a cover, the cover forming a tent enclosure and having a top and a bottom, the frame assembly comprising:

(a) a pair of brackets, each of the brackets adapted to be removably connected to the top of the cover, each of the brackets including a mounting plate having a central portion and a pair of side portions which extend from the central portion to form an included angle of less than 180°, a first tube connected to said central portion and second and third tubes being pivotally connected to said side portions whereby said second and third tubes can be pivoted between a first position in which the second and third tubes extend parallel to said first tube and a second position in which each of the second and third tubes extend perpendicular to the first tube, (b) an elongated ridge pole adapted to be connected to the first tube of each of said brackets to maintain the brackets in a spaced-apart condition, and a pair of upright poles for each of said brackets adapted to be connected to the second and third tubes of the brackets.

8. The tent assembly of claim 7 including a pair of elongated spreader rods adapted to be connected to the top of the cover, the mounting plate of each bracket including hook means for removably connecting the bracket to one of the spreader rods.

9. The tent assembly of claim 8 in which the hook means includes a hook portion extending from each of said side portions of the mounting plate.

10. The tent assembly of claim 8 including a fly support rod for each of the brackets, each of the fly support rods being adapted to be telescopingly connected to one of said first tubes.

11. A tent comprising a frame assembly and a cover supported by the frame assembly to form a tent enclosure, the cover including:

(a) a floor portion, (b) a top portion, (c) a pair of end wall portions, (d) a pair of side wall portions extending upwardly from the floor portion and joining the floor portion and the top portion, (e) a pair of generally parallel spreader sleeves, each of the spreader sleeves being adjacent the juncture between the top portion and one of the end wall portions, and (f) a ridge sleeve on the top portion extending generally perpendicularly to the spreader sleeves;

the frame assembly including:

(a) a pair of flexible rods, each of the spreader rods extending through one of the spreader sleeves on the cover;

(b) a pair of brackets, each of the brackets being removably mounted on the midportion of one of the spreader rods, each of the brackets including a first tube which extends toward the ridge sleeve of the cover and second and third tubes which extend generally downwardly and toward the side walls of the cover;

(c) a flexible ridge pole extending through the ridge sleeve of the cover and being connected to said first tube of each of the brackets, the length of the ridge pole being greater than the distance between the first tubes of the brackets so that the ridge pole bows upwardly and raises the ridge sleeve and the top portion of the cover, and (d) first and second pairs of upright poles, the upright poles of said first pair being connected to the second and third tubes of one of said brackets and the upright poles of said second pair being connected to the second and third tubes of the other of said brackets for supporting the brackets, the spreader rods, and the ridge pole.

12. The tent of claim 11 in which each of the brackets includes a mounting plate, the second and third tubes of each bracket being pivotally connected to the mounting plate of the bracket whereby the angle between the second and third tubes and the upright poles attached thereto can be varied by pivoting the second and third tubes.

13. The tent of claim 12 in which the mounting plate for each of the brackets includes a central portion and a pair of side portions which extend from the central portion to form an included angle of less than 180°, said first tube being connected to said central portion and each of said second and third tubes being pivotally connected to one of said side portions whereby said second and third tubes can be pivoted between a first position in which the second and third tubes extend parallel to said first tube and a second position in which each of the second and third tubes extend perpendicular to the first tube.

14. The tent of claim 13 in which each of the upright poles is connected to the cover adjacent to one of the corners of the cover defined by the junction between an end wall portion and a side wall portion, the distance between the corners of each end wall being less than the distance between the ends of a pair of upright poles when the second and third tubes of the associated bracket extend perpendicularly to said first tube whereby the upright poles will hold the end walls of the cover taut.

15. A tent comprising a frame assembly and a cover supported by the frame assembly to form a tent enclosure, the cover including:

(a) a floor portion, (b) a top portion, (c) a pair of end wall portions, (d) a pair of side wall portions extending upwardly from the floor portion and joining the floor portion and the top portion, (e) a pair of generally parallel spreader sleeves, each of the spreader sleeves being adjacent the juncture between the top portion and one of the end wall portions, and (f) a ridge sleeve on the top portion extending generally perpendicularly to the spreader sleeves;

the frame assembly including:

(a) a pair of spreader rods, each of the spreader rods extending through one of the spreader sleeves on the cover, a pair of brackets, each of the brackets being removably mounted on the midportion of one of the spreader rods, each of the brackets including a mounting plate having a central portion and a pair of side portions which extend from the central portion to form an included angle of less than 180°, a first tube being connected to said central portion and second and third tubes being pivotally connected to said side portions whereby said second and third tubes can be pivoted between a first position in which the second and third tubes extend parallel to said first tube and a second position in which each of the second and third tubes extend perpendicular to the first tube, (b) a first pole extending through the ridge sleeve of the cover and being connected to said first tube of each of the brackets, and (c) first and second pairs of upright poles, the upright poles of said first pair being connected to the second and third tubes of one of said brackets and the upright poles of said second pair being connected to the second and third tubes of the other of said brackets for supporting the brackets, the spreader rods, and the ridge pole.

* * * * *